United States Patent [19]

Hestehave et al.

[11] Patent Number: 4,488,584

[45] Date of Patent: Dec. 18, 1984

[54] DRAINER CONTAINER AND FUNNEL

[75] Inventors: Borge Hestehave, Alta Loma; Kjeld Hestehave, Upland, both of Calif.

[73] Assignee: Bomatic, Inc., Ontario, Calif.

[21] Appl. No.: 534,288

[22] Filed: Sep. 21, 1983

Related U.S. Application Data

[63] Continuation-in-part of Ser. No. 429,854, Sep. 30, 1982, abandoned.

[51] Int. Cl.[3] ..... B65B 39/00

[52] U.S. Cl. ..... 141/339; 141/331

[58] Field of Search ..... 141/297-300, 141/331-345, 98; 220/1 C, DIG. 6, 370; 184/1.5, 106

[56] References Cited

U.S. PATENT DOCUMENTS

| | | | |
|---|---|---|---|
| 583,791 | 6/1897 | Disch | 4/258 |
| 618,996 | 7/1899 | Reidel et al. | 141/297 |
| 1,987,020 | 1/1935 | Looft | 4/DIG. 18 |
| 3,452,895 | 7/1969 | Kalkowski | 220/370 |
| 4,022,257 | 5/1977 | O'Connell | 184/106 X |
| 4,301,841 | 11/1981 | Sandow | 141/98 X |

FOREIGN PATENT DOCUMENTS

| | | | |
|---|---|---|---|
| 1416096 | 12/1975 | United Kingdom | 220/DIG. 6 |

*Primary Examiner*—Stephen Marcos
*Assistant Examiner*—Mark Thronson
*Attorney, Agent, or Firm*—Sixbey, Friedman & Leedom

[57] ABSTRACT

A drainer container and funnel having a container with an elongated internal receiving chamber that is defined by a pair of opposed major walls and at least one minor wall that interconnects the major walls, and a funnel that is detachably attachable to one of the major walls. The wall to which the funnel is attached is provided with an inwardly recessed funnel receiving wall portion and an aperture therethrough at an innermost part thereof. The funnel has a spout portion that is detachably connected to the recessed wall portion in such a manner as to communicate with the internal chamber of the container through the aperture, and the funnel being of a size and shape so as to be substantially entirely received within the recessed wall portion of the container when connected thereto. When the funnel is detached, a closure seals the aperture in the recessed wall portion.

19 Claims, 11 Drawing Figures

DRAINER CONTAINER AND FUNNEL

BACKGROUND OF THE INVENTION

This application is a continuation-in-part of our application co-pending U.S. application Ser. No. 429,854, filed Sept. 30, 1982, now abandoned.

The present invention relates generally to containers into which liquids are drained by way of a funnel. More particularly, the present invention relates to container-funnel arrangements specifically designed to facilitate the draining of oil from a motor vehicle, as well as the storage and transportation of the oil drained.

Containers with funnels for the above-noted purposes are known in the prior art. Some of these prior art arrangements, such as those of U.S. Pat. No. De. 220,470 and U.S. Pat. No. Re. 27,449 comprise a container of rectangular box-shape that has a handle and pouring spout at a narrow top end thereof, and a unitarily formed funnel configuration formed as part of a wide side wall thereof. A problem associated with the use of such containers is that, because the funnel is a permanent part of the outer side wall of the container, unless the funnel is cleaned promptly after usage, oil adhering to the funnel wall surfaces can drip off the funnel when it is raised to a vertical storage orientation of the container, could pose a problem with regard to the inadvertent staining of the clothing of someone brushing against the side of the container. An additional problem associated with such containers is that, due to the relative shallowness of the funnel and low sloping of the funnel walls, unless the opening from the bottom of the funnel into the container is closely aligned with the drain hole of the automotive vehicle (a difficult situation to create due to the normal road clearance of a vehicle), the oil draining from the vehicle drain hole will impact against the funnel walls and splash out of the container onto the container walls and surrounding floor area.

Another type of oil can and funnel combination is the type represented by U.S. Pat. Nos. 589,659 and 4,149,575. In the arrangements of these patents, the funnel is provided with a threaded bottom opening that is designed to threadingly engage with a filling opening in the top of a cylindrical container. However, such container and funnel arrangements face the very real problem that the height of the funnel, when screwed on top of the top opening of the container, may be too high to fit under vehicles which have a relatively low clearance with respect to the ground, such as many sub-compact and sports-type vehicles. Additionally, funnels of the above-noted type have a relatively small maximum diameter, in contrast to those of the first mentioned type, making accurate positioning of the funnel underneath the vehicle drain opening important, particularly in the case of the funnel arrangement of U.S. Pat. No. 4,149,575, which has walls of relatively low slope that would be subject to the same splashing problem as the containers with funnel-shaped side walls.

The oil drain system of U.S. Pat. No. 4,195,710 seeks to deal with the problem of draining of all oil in a manner so as to catch all of the oil without spills, while also dealing with the problem of providing an arrangement that will be sufficiently low in height as to be conveniently inserted under a motor vehicle. This oil drain system utilizes a rectangular box-shaped container like the first mentioned type of prior art arrangement, but utilizes a separate funnel like the second group. However, in this case, the separate funnel cooperates with the same opening used to pour out the contents as the container, and the funnel is a disposable flexible member that is supported on a frame that is permanently, pivotably connected to the container. Additionally, the production of a container having such a pivotable funnel frame increases the initial cost of such a container, while the need for using a new funnel member with each use of the container, is an added cost item to the consumer each time he utilizes the oil drain system of this patent.

Accordingly, it is an object of the present invention to create a container and funnel arrangement that will be sufficiently low in height to be conveniently inserted under an automotive vehicle, while, at the same time, avoiding the problem of splashing of oil out of the funnel onto the surrounding area.

It is a further object of the present invention to provide a funnel arrangement that avoids the need to clean the walls of the container after each usage.

It is yet another object of the present invention to provide a container and funnel arrangement that can be economically manufactured, and convenient and inexpensive to use.

SUMMARY OF THE INVENTION

The above-noted disadvantages of the prior art are obviated by a container and funnel in accordance with the present invention, which, in the preferred embodiment disclosed herein, comprises a container of the so-called "Jerry can" type that has a side wall that is recessed for fully receiving a separate, detachable funnel member. In accordance with a particularly advantageous feature of the present invention, the upper mouth of the funnel is provided with a splatter screen which enables oil to drain therethrough, but acts to avoid splattering of oil out of the funnel. In regard to this last mentioned feature, it is noted that screens have been utilized in conjunction with oil draining funnels, as can be seen with reference to the above-noted U.S. Pat. No. 4,149,575. However, in such prior art uses, the screen is a relatively small member that merely covers the outlet from the funnel to the container for the purpose of preventing the oil pan nut or other objects from falling into the container. Accordingly, such screen members are neither intended to nor capable of preventing the above-noted splattering problem from occurring.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
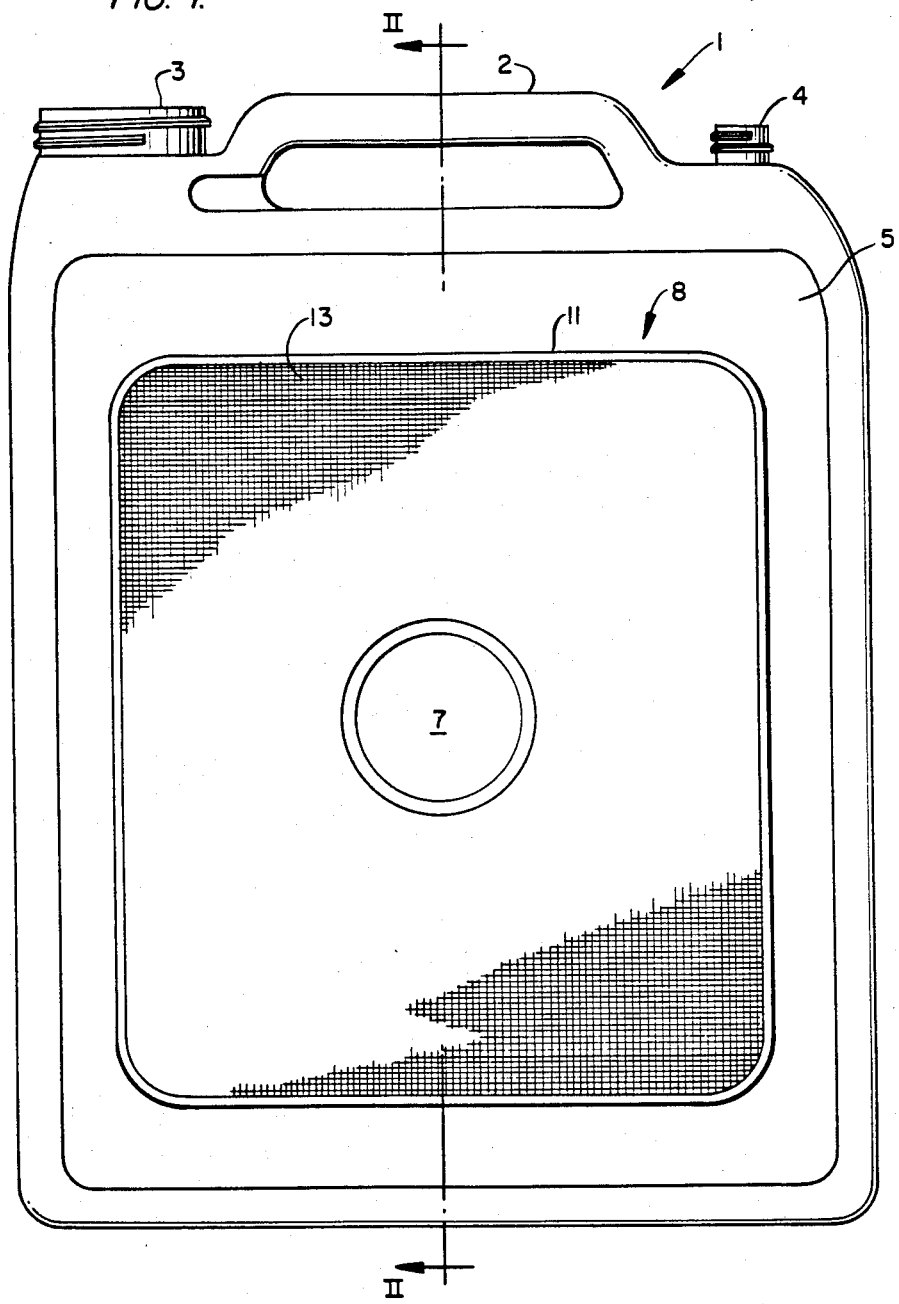
FIG. 1 is a plan view of a preferred embodiment container and funnel in accordance with the present invention, in a prone condition.
Figure 2:
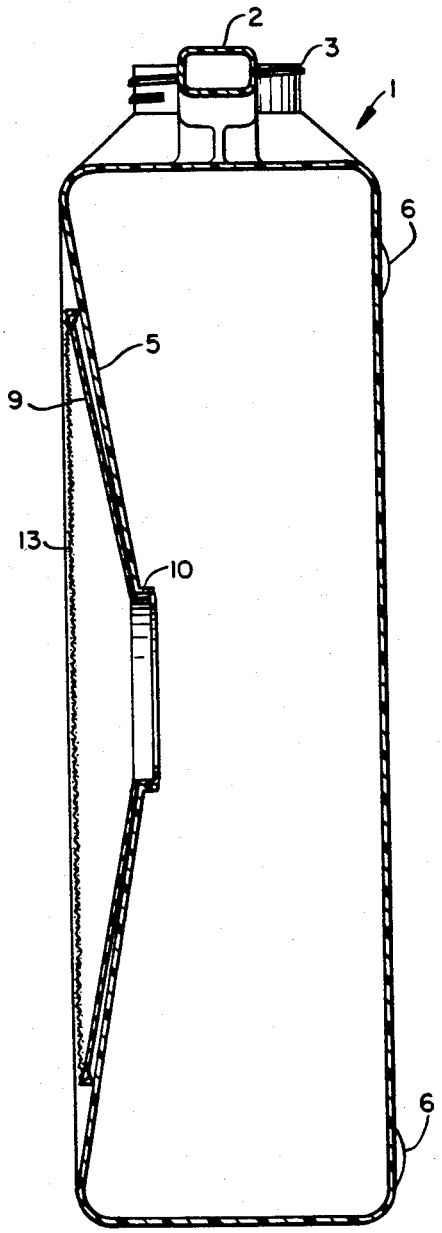
FIG. 2 is a cross-sectional view taken along line II—II of FIG. 1, but oriented in a vertically upright position.

In FIGS. 1 and 2, a container and funnel arrangement in accordance with the present invention is shown. This arrangement comprises a container 1, of the typical "Jerry can" type, that has been formed, for example, of plastic by blow-molding. As typical of such cans, it is of a generally rectangular box-shape with a handle 2 being provided on the narrow side, which would be disposed at the top end of the container 1, when it is placed in a vertically upright position. Likewise, container 1 is provided with a conventional threaded pouring spout 3 and vent opening 4 on the top end of the container 1, at opposite ends of the handle 2. Openings 3 and 4 can be sealed by conventional threaded caps (not shown). On one of the major faces of the container 1, a centrally inwardly sloping recessed wall surface 5, having a generally rectangular-shaped periphery closely adjacent the top, bottom, and side edges of the wall surface is provided, while the opposite, major wall of container 1 is advantageously, but not necessarily, provided with four unitary, supporting leg forming deformations 6. In this manner, the container may be positioned in a prone orientation, supported upon projections 6 with wall surface 5 facing upwardly.

Inwardly sloping recessed wall portion 5 is provided with a central aperture 7 into which a funnel 8 may be detachably connected, so that liquids draining down the walls of funnel 8 will be communicated into the interior of the container.

Figure 3:
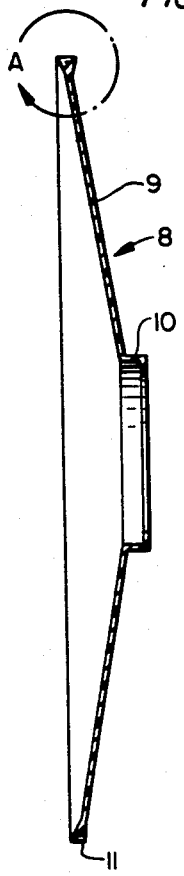
FIG. 3 is a cross-sectional view of the funnel shown in FIGS. 1 and 2.
Figure 4:
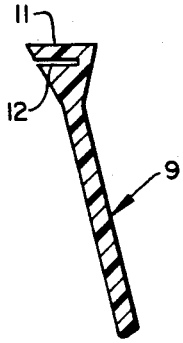
FIG. 4 illustrates a detail A of the funnel of FIG. 3.

With reference to FIG. 3, it can be seen that the funnel 8 has a funnel wall portion 9 and a spout portion 10. Funnel portion 10 has an outer diameter corresponding to the diameter of aperture 7 in the recessed wall portion 5 and has a radially inwardly directed rim at its outlet end for facilitating the snap-in retention of the spout portion 10 within the aperture 7. That is, the rim acts to cause the outlet end of the spout portion 10 to resist inward deformations thereof to a greater extent than its vertical wall portion, so that, upon forcing of the inlet end of the spout of the funnel through the aperture, a secure, but detachable, interconnection of the funnel to the container is obtained. As can be most clearly seen from FIG. 4, the inlet end of the funnel wall portion of the funnel has a cross-sectionally wedge-shaped bead 11. This bead 11 has an axially directed slot 12 into which the perimeter of a screen 13 is pressed, so as to be secured across the inlet end of the funnel. In order to properly function as a splatter screen, a relatively fine mesh material must be utilized, such as the type of screening commonly utilized for window and door ventilation screens, which have about 49 holes/cm$^2$. It has been found that such a screen will not interfere with a liquid, such as oil, being drained into the funnel, but will effectively inhibit splatters, which occur when the oil impacts against the walls of the funnel, from passing outwardly from the funnel through the screen.

The above-noted, wedge-like shape of bead 11, not only creates a sufficient thickness to enable a sufficiently deep slot 12 to be produced for properly gripping and holding the screen in place, but, since the wedge also causes the underside of the funnel wall portion 9 to be raised relative to recessed wall portion 5, it thus facilitates gripping of the edges of the funnel for disengaging it from the container 1.

Figure 5:
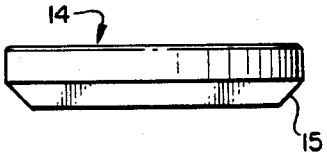
FIG. 5 is a side elevational view of a plug forming a part of the present invention.
Figure 6:
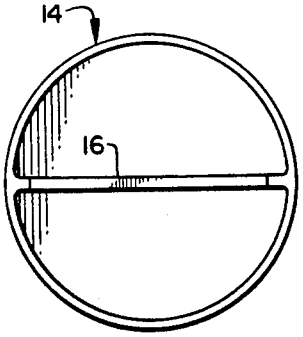
FIG. 6 is a plan view of the plug of FIG. 5.
Figure 7:
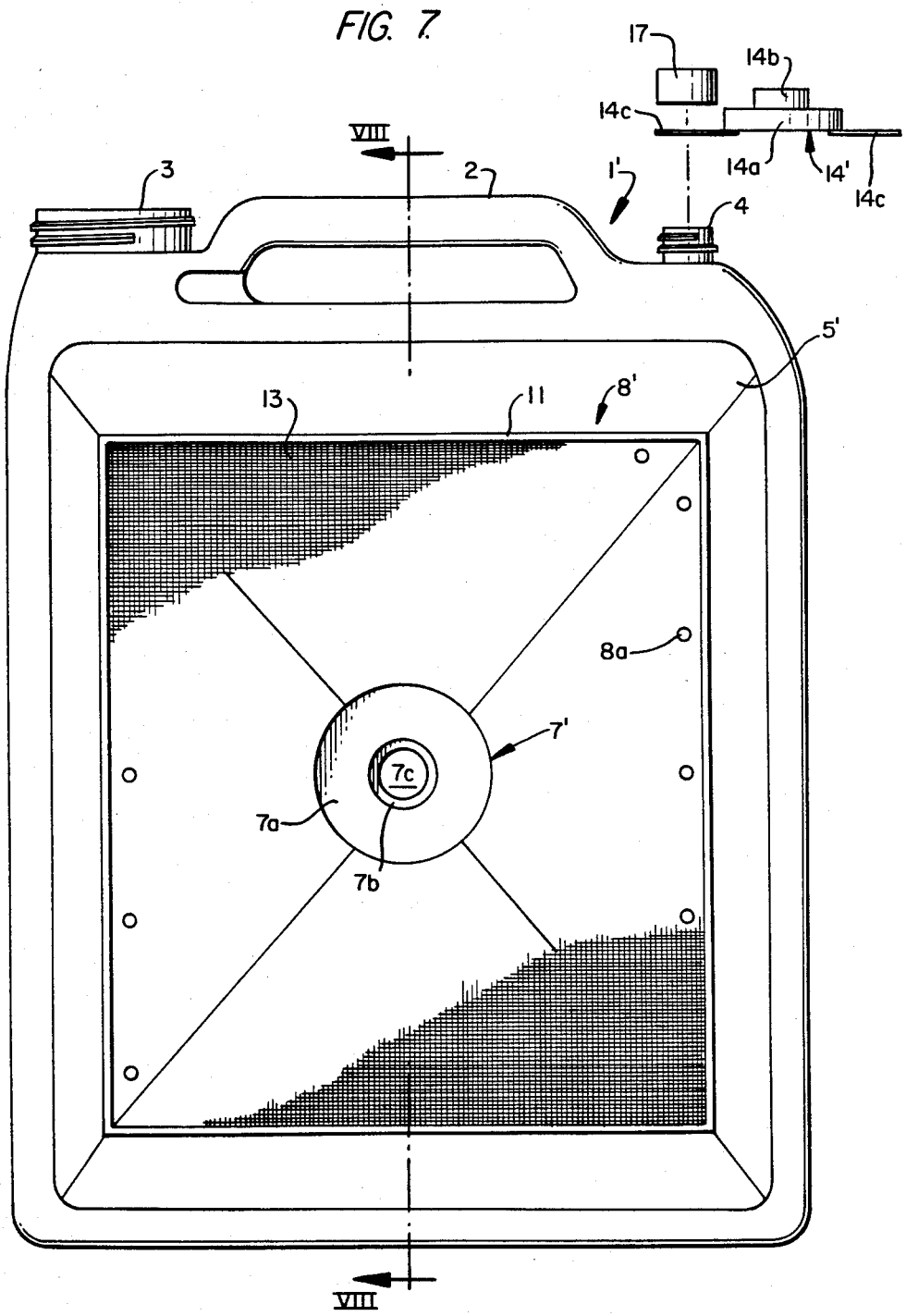
FIG. 7 is a plan view, similar to that of FIG. 1, but of a modified embodiment in accordance with the present invention.
Figure 8:
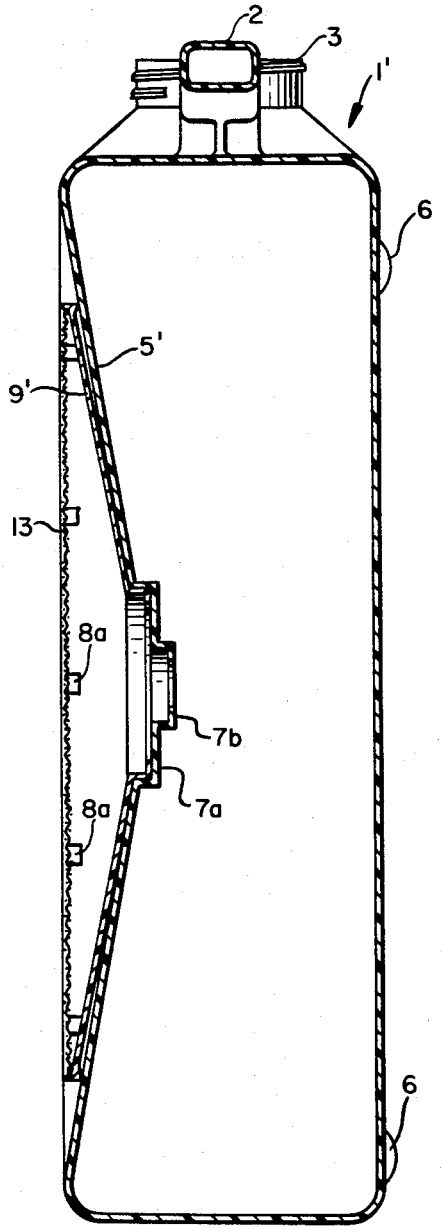
FIG. 8 is a cross-sectional view taken along line VII—VII of FIG. 7.
Figure 9:
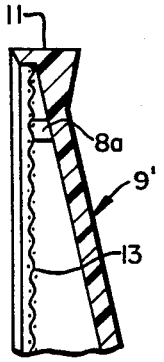
FIG. 9 is a partial sectional view corresponding to that of FIG. 4, but of the modified embodiment.

After the draining process has been completed and the funnel 8 disengaged from within aperture 7, the aperture 7 must be closed before the container 1 can be lifted into an upright, erect orientation. For this purpose, a plug 14 (FIGS. 5 and 6) is provided. Plug 14 has a maximum outer diameter corresponding to the outer diameter of the spout portion 10 of funnel 8 and a beveled portion 15 to facilitate insertion of the plug into aperture 7 (a similar function being served by a radius edge being provided on the outside of the spout at the junction between its radial rim and its cylindrical wall). To facilitate gripping and manipulating of the plug, a diametric rib 16 is provided that is flanked by a pair of semi-circular recesses.

As can be seen from FIG. 2 of the drawings, the present invention provides a funnel and container arrangement whereby the container, equipped with the funnel, is no greater in height in the prone position of the container (i.e., supported on projections 6) than it is without the funnel attached thereto. As a result, the container with funnel is not restricted in its applicability, relative to that of containers with unitary funnel walls, yet the detachability of the funnel avoids the cleanliness problems noted at the outset. Likewise, the construction of the funnel with a splatter screen avoids any spillage occurring from liquids splashing out of the shallow funnel.

A second embodiment of the invention will now be described with reference to FIGS. 7–11 of the drawings. In this respect, it is noted that elements of the embodiment of FIGS. 8–11, which are the same as those in the embodiment of FIGS. 1–7, bear like reference numerals, while a prime designation has been added where such corresponding components of the embodiment of FIGS. 8–11 have been modified in some respect to the embodiment of FIGS. 1–7. Furthermore, in view of the close relationship between the two embodiments, only those aspects of the FIGS. 7–11 embodiment which distinguish it from the embodiment of FIGS. 1–7 will be described, for the sake of brevity.

In this modified embodiment, the centrally inwardly sloping recessed wall surface 5' of the container 1', as well as the corresponding surface 9' of the funnel, have a substantially truncated pyramidal shape. This shape has been found to simplify manufacturing, particularly with respect to injection molding of the funnel A'.

A further modification incorporated into the wall portion 5' can be seen with respect to the central aperture 7', by which the funnel is detachably connected to the container. In particular, the aperture 7' is of a stepped configuration having a first, large surface area, recessed sealing wall 7a, within which is concentrically recessed a small surface area, sealing wall 7b. The aperture 7c is itself concentrically disposed within the wall 7b. The spout portion 10 of the funnel is retained in a snap-in manner by engagement thereof with the peripheral wall surrounding sealing surface 7a, or it may be given a stepped configuration (not shown), whereby it can sealingly engage against both surfaces 7*a*, 7*b* and, also optionally, be received in the aperture 7*c*.

A further modification can be seen with respect to the manner in which the screen 13 is attached to the funnel 9'. In particular, while the periphery of the funnel retains the generally wedge-like shape for the purpose of facilitating gripping of the edges of the funnel for disengaging it from the container, the slot 12 has been eliminated as the means for securing the screen across the inlet end of the funnel. Instead, funnel 8' is provided with a plurality of cylindric nub-like projections 8*a*, these projections 8*a* being spaced about the inlet end of the funnel 8' so as to have the end surfaces of the projections 8*a* all disposed within a substantially common plane parallel to the upper edge of the funnel. The screen 13 is secured in place by heat bonding thereof to the end surfaces of these projections 8*a*. This can be done by stretching the screen across the inlet end and then applying heat and pressure to the screen at each of the locations of the projections 8*a*, so as to melt the plastic material of these projections to such an extent that the adjacent portions of the screen can become fused to the end surfaces of the projections 8*a*.

Figure 10:
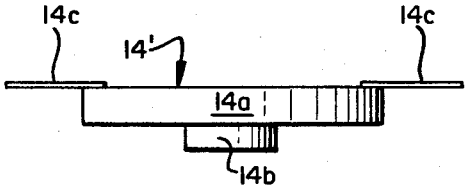
FIG. 10 is a side elevational view of a modified plug for use with the embodiment of FIG. 7 of the present invention.
Figure 11:
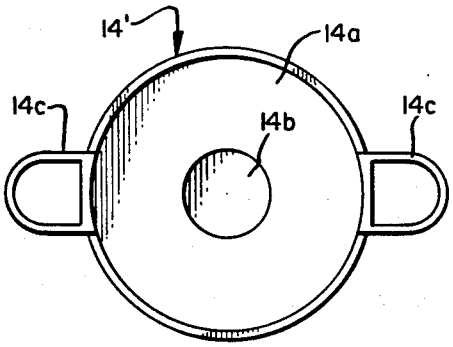
FIG. 11 is a plan view of the plug of FIG. 10.

A last modification incorporated into the embodiment of FIGS. 7–11 is the provision of a modified closure for the aperture 7', that takes the form of the modified plug 14' shown in FIGS. 10 and 11. Closure plug 14' has two hollow, concentrically disposed, cylindric portions 14*a*, 14*b*, whose exterior is sized and shaped so as to be snugly received within the aperture 7' of container 1' in engagement with each of the surfaces 7*a*, 7*b* thereof. This modified plug construction coacts with the modified aperture construction of the container, in order to provide a sure sealing of the drain aperture due to the presence of two coacting sealing surfaces on each of the plug and container aperture walls, and assures that the plug will not become inadvertently dislodged when the container 1' is lifted, from its prone position into a vertical orientation, as a result of a sudden redistribution of the oil within the interior of the container. In order to facilitate removal of the plug 14' for reinsertion of the funnel 8', a pair of finger loops 14*c* are secured diametrically opposite each other at the upper edge of plug portion 14*a*, instead of utilizing the rib 16 shown on plug 14. These finger loops 14*c*, in addition to providing a simple means for pulling the plug 14' out of the aperture 7', can serve as an easy means for attaching the plug 14' to the container 1', when not in use. That is, with reference to FIG. 7, by providing the cap 17 (utilized to close the vent opening 4) with an outer diameter that is greater than the minimum diameter of the finger loops 14*c* and by dimensioning the finger loops 14*c* so as to fit over the neck of the vent opening 4, the cap can be attached to the container by placing one of the loops 14*c* over the neck of the vent opening 4 and then threading the cap 17 in place.

While the preferred embodiments have been described with reference to generally rectangular, box-shaped containers of the "Jerry can" type, it should be appreciated that the present invention is also applicable to containers having flat top and bottom walls interconnected by a cylindrical side wall, such as that of the above-noted U.S. Pat. No. 4,149,575, such containers merely being less desirable from a convenience standpoint due to characteristics of such containers in general, and not due to any characteristic of the present invention. In such an application, instead of a generally rectangular shaped funnel and recessed wall, a recessed wall and funnel having a circular outer periphery would be provided.

While we have shown and described several embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. A drainer container and funnel comprising:

a container having an elongated internal receiving chamber defined by a pair of opposed major walls and at least one minor wall which interconnects said major walls, wherein a first of said opposed major walls is of a shape for supporting said container and wherein a second of said opposed major walls is provided with an inwardly recessed, funnel receiving, wall portion and an aperture therethrough at an innermost part of said recessed wall portion;

an essentially rigid funnel having a funnel wall portion and a spout portion, said spout portion being constructed for detachably connecting to said recessed wall portion in a manner communicating with said receiving chamber through the aperture therein, and said funnel wall portion being of a size and shape for being substantially entirely received with the recessed wall portion of the container when said spout portion is connected thereto; and closure means for sealing said aperture when said funnel is detached.

2. A drainer container and funnel according to claim 1, wherein said funnel further comprises a splatter preventing screen extending across an inlet end portion of the funnel.

3. A drainer container and funnel according to claim 2, wherein said screen has a relatively fine mesh of about 49 holes/cm$^2$.

4. A drainer container and funnel according to claim 3, wherein the inlet end of said funnel is provided with a circumferentially extending slot, said screen being fastened to said funnel by securement of the perimeter thereof in said slot.

5. A drainer container and funnel according to claim 2, wherein the inlet end of said funnel is provided with a circumferentially extending slot, said screen being fastened to said funnel by securement of the perimeter thereof in said slot.

6. A drainer container and funnel according to claim 1, wherein said inwardly recessed, funnel receiving, wall portion is formed of a funnel-like shape substantially corresponding to that of said funnel.

7. A drainer container and funnel according to claim 6, wherein said funnel-like shape is substantially frusto-pyramidal shaped.

8. A drainer container and funnel according to claim 6, wherein said recessed wall portion extends, at its upper outer border, to adjacent the periphery of said second major wall.

9. A drainer container and funnel according to claim 7, wherein said container is of a generally rectangular box-shape having a plurality of minor walls interconnecting said major walls, a first of said minor walls being of a shape, size and location for supporting the container in an upright orientation, wherein said major walls are vertically situated, and second of said minor walls being provided with a handle means for transporting said container, said second minor wall being located at an opposite end of the container from said first minor wall.

10. A drainer container and funnel according to claim 9, wherein said second minor wall is provided with a pouring opening.

11. A drainer container and funnel according to claim 6, wherein the construction for enabling the detachable connection of the funnel to the recessed wall portion comprises said spout portion being of a size and shape corresponding to that of a recessed aperture wall section defining said aperture and by the provision of a radially inwardly directed rim at an outlet end thereof for facilitating a snap-in retention of said spout portion within said aperture wall section.

12. A drainer container and funnel according to claim 11, wherein said aperture wall section comprises a first, large area, recessed sealing surface and a second, small area, recessed sealing surface disposed concentrically within the first recessed sealing surface, said aperture being concentrically disposed within said second recessed surface.

13. A drainer container and funnel according to claim 12, wherein said closure means comprises a plug having a stepped configuration that is dimensioned so as to be received within said recessed aperture wall section in sealing engagement with both of said sealing surfaces.

14. A drainer container and funnel according to claim 13, wherein said closure means is provided with at least one finger loop at an upper edge thereof for extracting said closure means from said recessed aperture section, said container is provided with a neck defining a vent opening and a closure cap for said vent neck, and wherein said finger loop, said neck, and said cap are so dimensioned relative to each other as to enable the finger loop to be disposed over said neck and retained thereon by the closure cap.

15. A drainer container and funnel according to claim 2, wherein a plurality of nub-like projections are spaced circumferentially about an inlet end portion of said funnel in a substantially common plane, and wherein said screen is fastened to said funnel by heat bonding of perimetric portions of said screen to end surfaces of said nub-like projections.

16. A drainer container and funnel according to claim 3, wherein said closure means is provided with at least one finger loop at an upper edge thereof for extracting said closure means from said aperture, said container is provided with a neck defining a vent opening and a closure cap for said vent neck, and wherein said finger loop, said neck, and said cap are so dimensioned relative to each other as to enable the finger loop to be disposed over said neck and retained thereon by the closure cap.

17. A drainer container and funnel according to claim 2, wherein said inwardly recessed, funnel receiving, wall portion is formed of a funnel-like shape substantially corresponding to that of said funnel.

18. A drainer container and funnel according to claim 17, wherein said funnel-like shape is substantially frusto-pyramidal shaped.

19. A drainer container and funnel according to claim 18, wherein said closure means is provided with at least one finger loop at an upper edge thereof for extracting said closure means from said aperture, said container is provided with a neck defining a vent opening and a closure cap for said vent neck, and wherein said finger loop, said neck, and said cap are so dimensioned relative to each other as to enable the finger loop to be disposed over said neck and retained thereon by the closure cap.